United States Patent [19]

Leonard

[11] Patent Number: 4,846,519

[45] Date of Patent: Jul. 11, 1989

[54] HAND PROTECTING GRIP FOR USE WITH SHOPPING BAGS AND THE LIKE

[76] Inventor: Wesley Leonard, Hancock Point Rd., Hancock, Me. 04540

[21] Appl. No.: 204,353

[22] Filed: Jun. 9, 1988

[51] Int. Cl.[4] ..... A45F 5/10; B65D 33/06

[52] U.S. Cl. ..... 294/171

[58] Field of Search ..... 294/137, 153, 154, 156, 294/170, 171; 16/114 B, DIG. 12; 383/6, 13, 25, 29

[56] References Cited

U.S. PATENT DOCUMENTS

| | | | |
|---|---|---|---|
| 1,576,546 | 3/1926 | Ransom | 294/171 |
| 1,678,005 | 7/1928 | Hallerman | 294/171 |
| 2,287,329 | 6/1942 | Santa Maria et al. | 294/171 |
| 2,444,558 | 7/1948 | Elliott | 294/171 |

FOREIGN PATENT DOCUMENTS

| | | | |
|---|---|---|---|
| 1235049 | 5/1960 | France | 294/171 |
| 911948 | 12/1962 | United Kingdom | 294/171 |
| 2113081 | 8/1983 | United Kingdom | 294/171 |
| 2142227 | 1/1985 | United Kingdom | 294/171 |

*Primary Examiner*—Johnny D. Cherry

*Attorney, Agent, or Firm*—Donald A. Kettlestrings

[57] ABSTRACT

A hand protecting grip for use with shopping bags and the like includes an elongated body defining an interior, longitudinally-extending circular bore and a longitudinally-extending bag handle admission slot in fluid communication with the bore. A bag handle support surface within the bore defines opposed ends which are rounded downwardly, and opposed ends of the slot meet the opposed ends of the bag support surface whereby bag bails can be quickly inserted into and removed from the grip.

4 Claims, 1 Drawing Sheet

HAND PROTECTING GRIP FOR USE WITH SHOPPING BAGS AND THE LIKE

This invention relates to hand protecting grips and more particularly to a hand protecting grip for use with shopping bags and the like.

Various types of hand protecting grips for use with shopping bags are known. For example, Ransom, U.S. Pat. No. 1,576,546 describes a package carrier adapted for use in carrying boxes, bags and other similar receptacles. Santa Maria et al., U.S. Pat. No. 2,287,329 describes a hand protecting grip for attachment to cord or wire handles of shopping bags to prevent the handles from cutting, chafing or otherwise injuring the hand or fingers of the user. Elliott, U.S. Pat. No. 2,444,558 describes a service handle for use in carrying market bags.

Although such devices and other devices known in the art have served the purpose, they have not proved entirely satisfactory under all conditions of service.

It is, therefore, an object of the present invention to provide a hand protecting grip for use with shopping bags and the like which provides for quick and easy insertion of bag bails into the grip.

Another object is to provide a hand protecting grip for use with shopping bags and the like which enables bag bails to be quickly and easily removed from the grip.

A further object of the invention is the provision of such a hand protecting grip which provides for increased stability during use.

Still another object is to provide such a hand protecting grip which readily accommodates large and bulky bag bails.

Yet another object of the present invention is the provision of such a hand protecting grip which is capable of carrying bag bails of relatively large volume in relation to the overall volume and bulk of the grip.

A still further object is to provide such a hand protecting grip which is designed to prevent rolling of the grip in the user's hand and displacement of the bag bails.

Another object is to provide such a hand protecting grip which effectively prevents bag bails from inadvertently exiting the grip.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a hand protecting grip for use with shopping bags and the like, the grip comprising an elongated tubular body defining an interior, longitudinal, substantially circular bore and defining a longitudinally-extending bag handle support surface within the bore; the body further defining along an upper portion and at opposed ends thereof a substantially longitudinally-extending bag handle admission slot positioned substantially opposite from the support surface and in fluid communication with the bore; opposed ends of the support surface being rounded downwardly away from the upper portion of the body; and the slot further defining opposed ends which meet the opposed ends of the support surface.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

Figure 1:
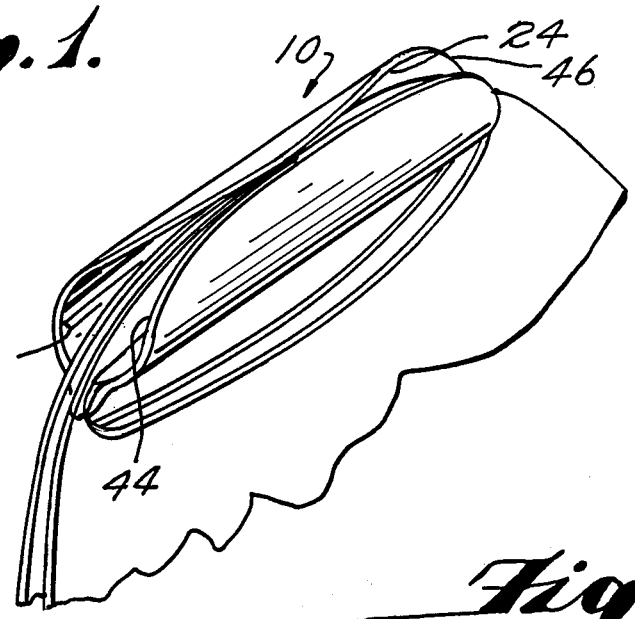
FIG. 1 is a perspective view of the grip showing use of the grip to hold a bag.

With reference now to the drawings, wherein like reference characters designate like or corresponding parts throughout the several views, there is shown a hand protecting grip 10 in accordance with the invention for use with shopping bags and the like. Grip 10 is comprised of an elongated tubular body 12 which defines an interior, longitudinal, substantially circular bore 14. Body 12 includes a longitudinally-extending bag handle support Body 12 further defines along an upper portion 18 and surface 16 within bore 14. at opposed ends 20, 22 thereof a substantially longitudinally-extending bag handle admission slot 24 positioned substantially opposite from support surface 16 and in fluid communication with bore 14.

Opposed ends 26, 28 of support surface 16 are each rounded downwardly away from upper portion 18 of body 12, and slot 24 further defines opposed ends 30, 32 which meet opposed ends 26, 28, respectively, of support surface 16.

In accordance with the invention, slot 24 increases in width from the transverse center 34 of body 12 to predetermined locations 36, 38 adjacent to and interior of opposed ends 20, 22, respectively, of body 12. Each end portion of slot 24 decreases in width from locations 36, 38 to where slot 24 meets support surface 16 at ends 20, 22, respectively.

Figure 4:
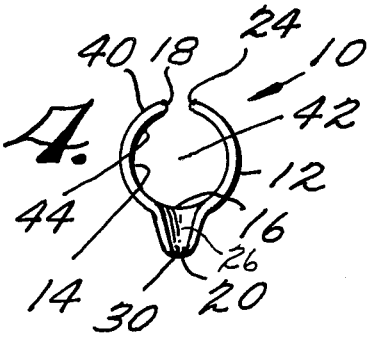
FIG. 4 is an end elevation view of the grip.

Grip 10 defines a centrally located, longitudinally-extending axis 42 (FIG. 4), and support surface 16 is located below axis 42 to provide stability for bag bails held by the grip on support surface 16.

The interior transaxial dimensions of bore 14 are substantially identical over the entire length of grip 10 to provide maximum bag bail carrying capacity. Body 12 is formed by a wall 40 having a thickness substantially less than the interior diameter of bore 14 whereby grip 10 enables a relatively large volume of material or bag bails to be placed and held within bore 14 in relation to the overall volume and bulk of grip 10.

Figure 2:
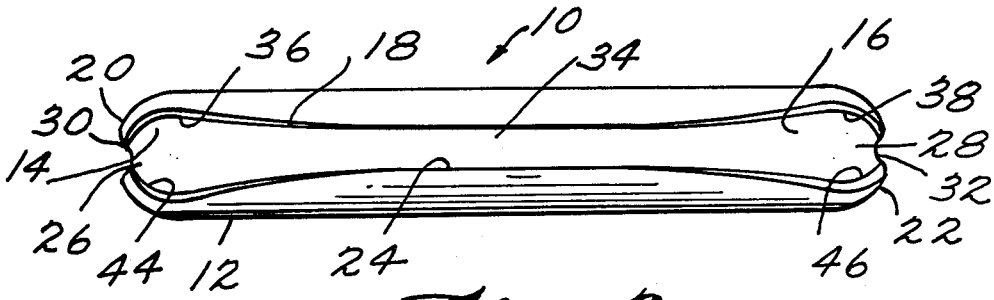
FIG. 2 is a top plan view of the grip.
Figure 3:
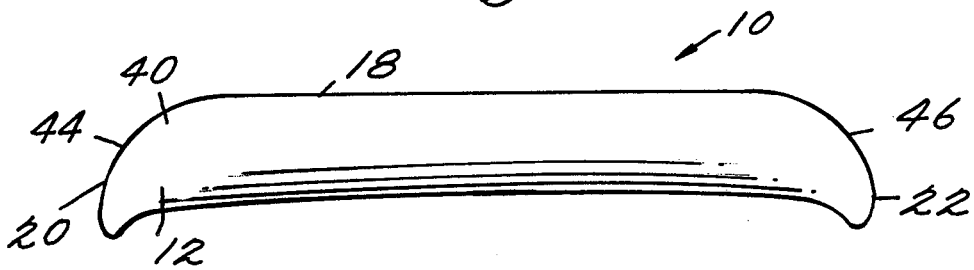
FIG. 3 is a side elevation view of the grip.

In use, bag bails or the like are inserted into grip 10 through slot 24 and the bails are positioned onto and are supported by support surface 16. Because grip 10 provides for large and unimpeded end openings 44, 46, easy access for the bag bails into bore 14 is provided. The gradual narrowing of slot 24 toward transverse center 34 (FIG. 2) of body 12 also enables the bag bails to be quickly and easily inserted into bore 14 while also retaining the bag bails within bore 14 once they have been positioned within the bore. Grip 10 provides an extremely stable holder for the bag bails because the bails are carried and supported by surface 16 below axis 42. Because the interior dimensions of bore 14 are substantially the same over the entire length of grip 10, the grip can accommodate more or bulkier bag bails than can the prior art grips. Downwardly rounded ends 26, 28 of support surface 16, together with the feature providing for the bag bails to be positioned beneath axis 42, provide stability for grip 10 and prevent its rolling in the user's hand and any displacement of the bag bails.

The invention in its broader aspects is not limited to the specific details shown and described, and departures may be made from such details without departing from the principles of the invention and without sacrificing its chief advantages.

What is claimed is:

1. A hand protecting grip for use with shopping bags and the like, said grip comprising:

an elongated tubular body defining an interior longitudinal, substantially circular bore and defining a longitudinally-extending bag handle support surface within said bore;

said body further defining along an upper portion and at opposed ends thereof a substantially longitudinally-extending bag handle admission slot positioned substantially opposite from said support surface;

opposed ends of said support surface being rounded downwardly away from said upper portion of said body; and said slot further defining opposed ends which meet said opposed ends of said support surface, and said slot increasing in width from the transverse center of said body to predetermined locations adjacent to and interior of said opposed ends of said body and said slot continuously decreasing in width from said predetermined locations to where said slot meets said support surface.

2. A hand grip as in claim 1 wherein said body is formed by a wall having a thickness substantially less than the interior diameter of said circular bore whereby said grip enables a relatively large volume of material to be placed and held within said bore in relation to the overall volume and bulk of said grip.

3. A hand grip as in claim 2 wherein said grip defines a centrally located longitudinally-extending axis and wherein said support surface is located below said axis to provide stability for bag bails held by said grip on said support surface.

4. A hand grip as in claim 3 wherein the interior transaxial dimensions of said bore are substantially identical over the entire length of said grip.

* * * * *